United States Patent [19]

Drake et al.

[11] 4,442,620

[45] Apr. 17, 1984

[54] FAST MUZZLE-LOADING DEVICE

[76] Inventors: Stephen C. Drake, R.D. #3 Box 38-A, Slatington, Pa. 18080; Richard G. Bosse, R.D. 2 Box 386-6AA, Coplay, Pa. 18037

[21] Appl. No.: 366,375

[22] Filed: Apr. 5, 1982

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 3,775,889 | 12/1973 | Wilburn | 42/90 |
| 4,050,175 | 9/1977 | Mulinix | 42/90 |
| 4,094,098 | 6/1978 | Gourley | 42/90 |
| 4,152,858 | 5/1979 | Dobbs | 42/90 |
| 4,229,897 | 10/1980 | Snowden | 42/90 |
| 4,369,594 | 1/1983 | Zurga | 42/90 |

*Primary Examiner*—Charles T. Jordan

[57] ABSTRACT

A device for rapid loading of a muzzle-loaded firearm, our invention provides a method to carry, in ready position, all of the ingredients and implements necessary to reload a muzzle-loading firearm, both flintlock and percussion. In addition, our invention facilitates very rapid reloading due, in part, to an exclusive T-slot spring slide system which is lever activated. The device is positioned over the gun barrel, facilitated by a recess in the block; the lever is moved in either direction, thus releasing the spring slide to position itself in the open position. When this is done, the gun powder falls into the barrel and the patch and ball are then pushed through with a handily located ball starter. Priming is accomplished by using either the priming powder squeeze bottle in the case of a flintlock firearm or by removing a percussion cap from the carrying strap in the case of a percussion type firearm.

4 Claims, 4 Drawing Figures

FAST MUZZLE-LOADING DEVICE

BACKGROUND OF THE INVENTION

1. Field of the Invention

The present invention pertains to the loading of muzzle-loading firearms. More particularly, the invention relates to a device for carrying all of the necessary supplies to quickly reload a muzzle-loading firearm, both flintlock type and percussion type.

2. Discussion of the Prior Art

There are various implements known to us in the prior art which facilitate the loading of muzzle-loading firearms. Some are multiple shot devices; some hold most of the necessary ingredients, but none, excepting the present invention, off both. Devices such as those invented by Gourley, U.S. Pat. No. 4,094,098, and Zurga, U.S. Pat. No. 4,369,594, merely hold a multitude of balls and patches. One still needs the gun powder, ball starter and pan powder or percussion cap in order to be ready for firing. Another invention, that of Snowden, U.S. Pat. No. 4,229,897, provides a receptacle for most, but not all of the paraphernalia required; however, it is designed for only one shot. Another invention, that of Wilburn, U.S. Pat. No. 3,775,889, by its own summary is merely a magazine receptacle for some of the necessary ingredients. The present invention stores all of the ingredients in a ready-to-load manner.

Other past inventions such as Griffin, U.S. Pat. No. 4,112,606, and Mulinix, U.S. Pat. No. 4,050,175, and Dobbs, U.S. Pat. No. 4,152,858, are also strictly one-shot devices and considerably more time consuming. Each of the aforementioned inventions conspicuously lack a means to store or use one necessary ingredient for flintlock firearms, that is, the ignition or pan powder. The present invention offers a convenient receptacle of a nature to facilitate this step of the reloading process.

SUMMARY OF THE INVENTION

The ingredients and implements which are necessary to load a muzzle-loading firearm include the gun powder, the ball, the patch and the ball starter. With the insertion and utilization of these, the firearm is considered to be loaded. To be ready to fire, pan powder which is inserted into the primer flash pan in the case of a flintlock type firearm, or a cap in the case of a percussion type firearm is also necessary.

After a muzzleloader shooter takes his first shot, it is convenient, in the case of a target shooter, and often critical, in the case of the hunter, to reload as quickly as possible. The main object of the present invention is to allow the shooter to completely reload, ready to fire, in a short period of time, a plurality of times; said allowance is facilitated by such means as a T-slot spring slide system, an indentation for patch centering and a gun barrel centering recess.

A further object of the invention is to provide, in a ready-to-load manner, receptacles for holding all of the ingredients necessary to completely reload a muzzle-loading firearm.

An additional object of the present invention is to provide all of the equipment necessary to quickly reload, exempting the ramrod, which is considered to be part of the firearm itself, and including ball starter and priming powder container.

A further object of this invention is to provide for a plurality of reloads.

Another object of the present invention is to provide convenience of utilization by means of an attached strap that can be placed around the shooter's neck, thus putting the apparatus in a most convenient position.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF PREFERRED EMBODIMENT

Figure 3:
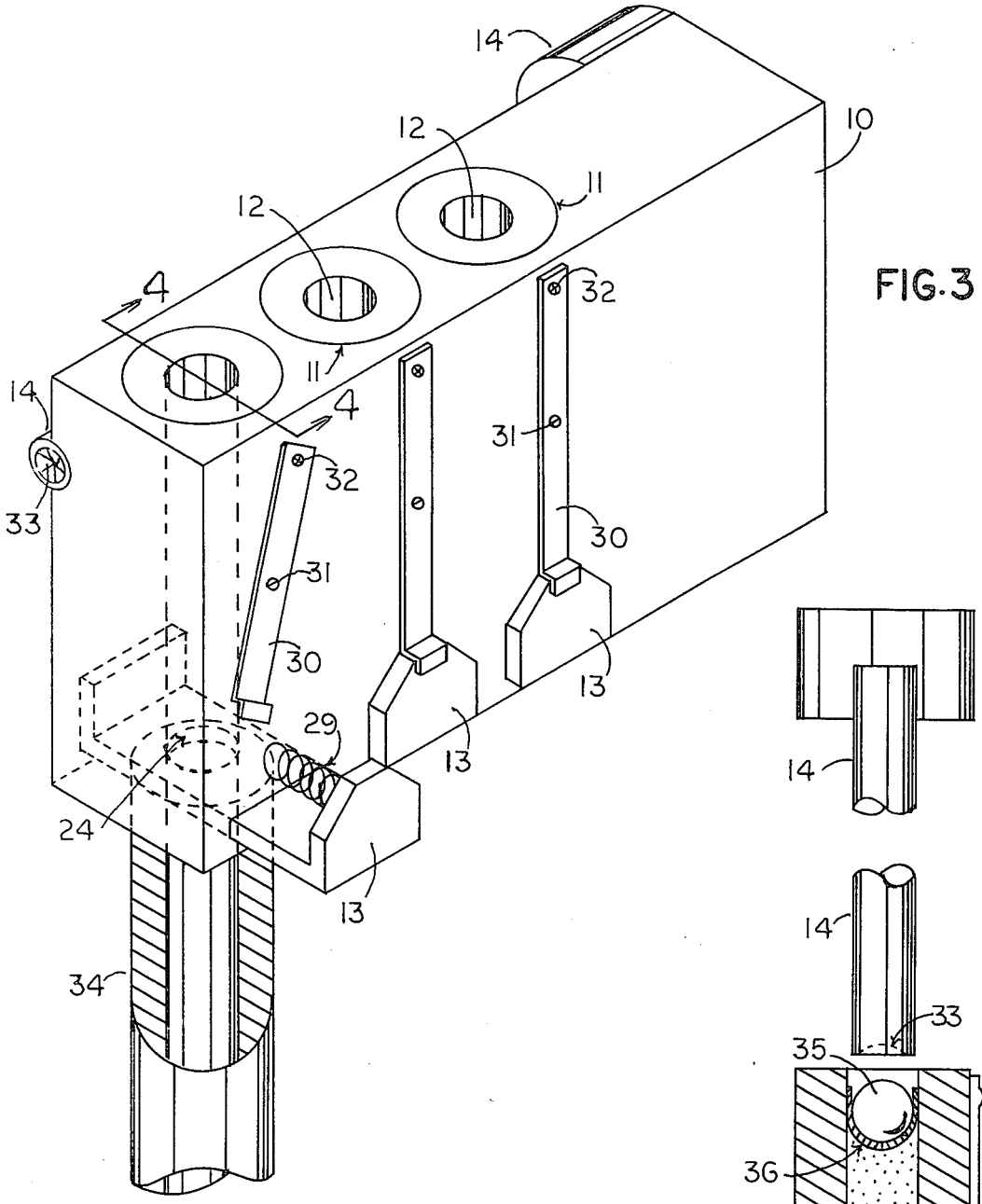
FIG. 3 is a combination top perspective and sectional view that best describes how the loading block is used in conjunction with the gun barrel.
Figure 4:
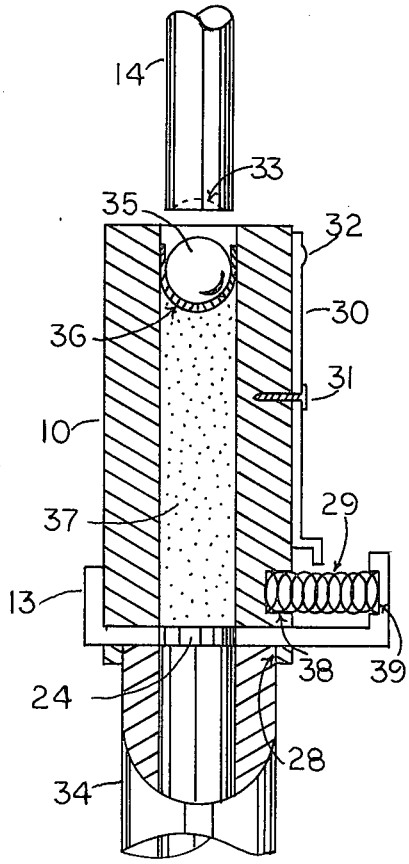
FIG. 4 is a longitudinal section taken along the line 4—4 of FIG. 3, disclosing the loading block in loading position upon the barrel of the gun.

Referring more specifically to the drawings, the loading block (10) consists of a block of wood or plastic with holes (12) bored longitudinally through it. When in use, these holes store the gun powder (37), the patch (36) and the ball (35). At the bottom of each hole (12) is a slide (13) which fits through a milled T-slot (27). A hole (24) is bored in each slide in such a location that when the slide (13) is in released position, hole (24) aligns with hole (12). The locked and released positions are accomplished by use of spring (29) and lever (30). To lock, slide (13) is pushed in against spring (29) tension and lever (30) is slid over slide (13). To release, push lever (30) which is secured by screw (31) in either direction. This pushing action is facilitated by raised extrusion (32) as shown in FIG. 3 and FIG. 4. When the slide (13) is released, the gun powder (37) passes through hole (24) and into gun barrel (34). Barrel (34) fits snuggly into recess (28). The ball starter (14) is then used to push ball (35) and patch (36) into barrel (34). The ball starter (14) self-aligns with ball (35) due to concave recess (33). Referring also to FIG. 4, it can be seen here that spring (29) can be compressed and hidden in block recess (38) and slide recess (39). This allows the slide (13) to close tightly against block (10).

Figure 1:
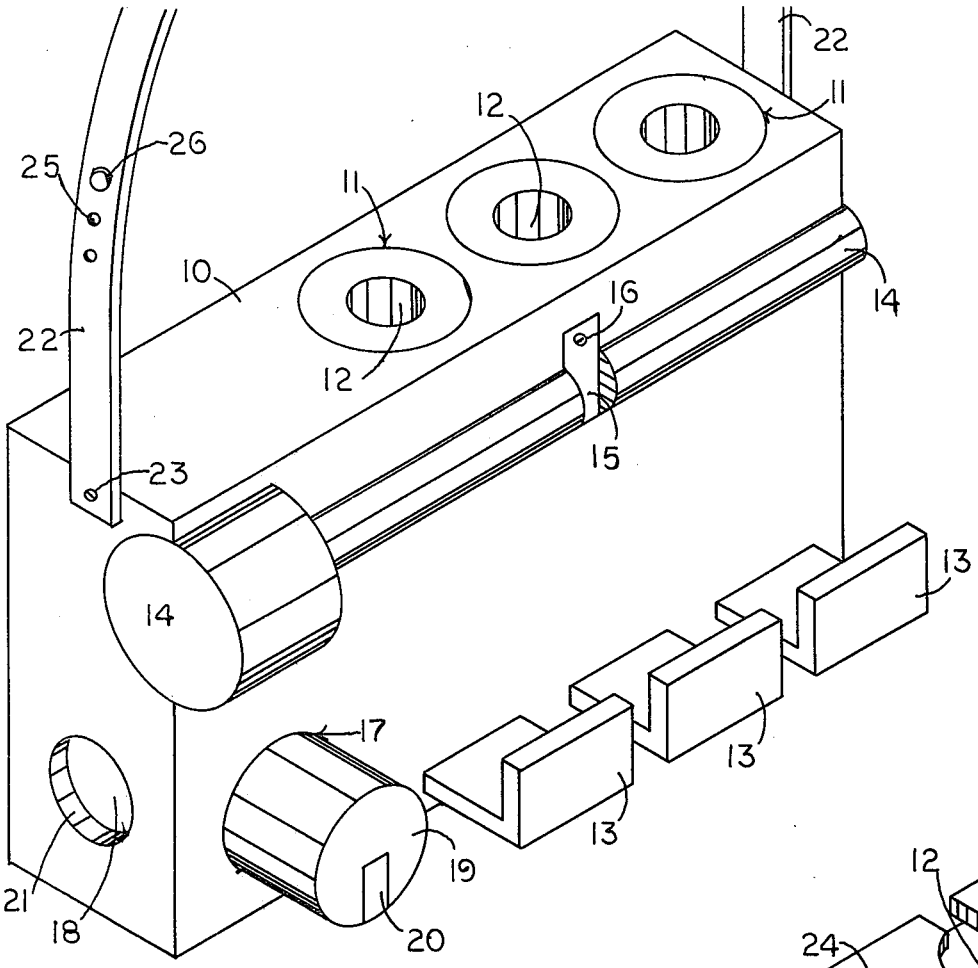
FIG. 1 is a top perspective view of the loading block as it is used and carried by the black powder shooter.
Figure 2:
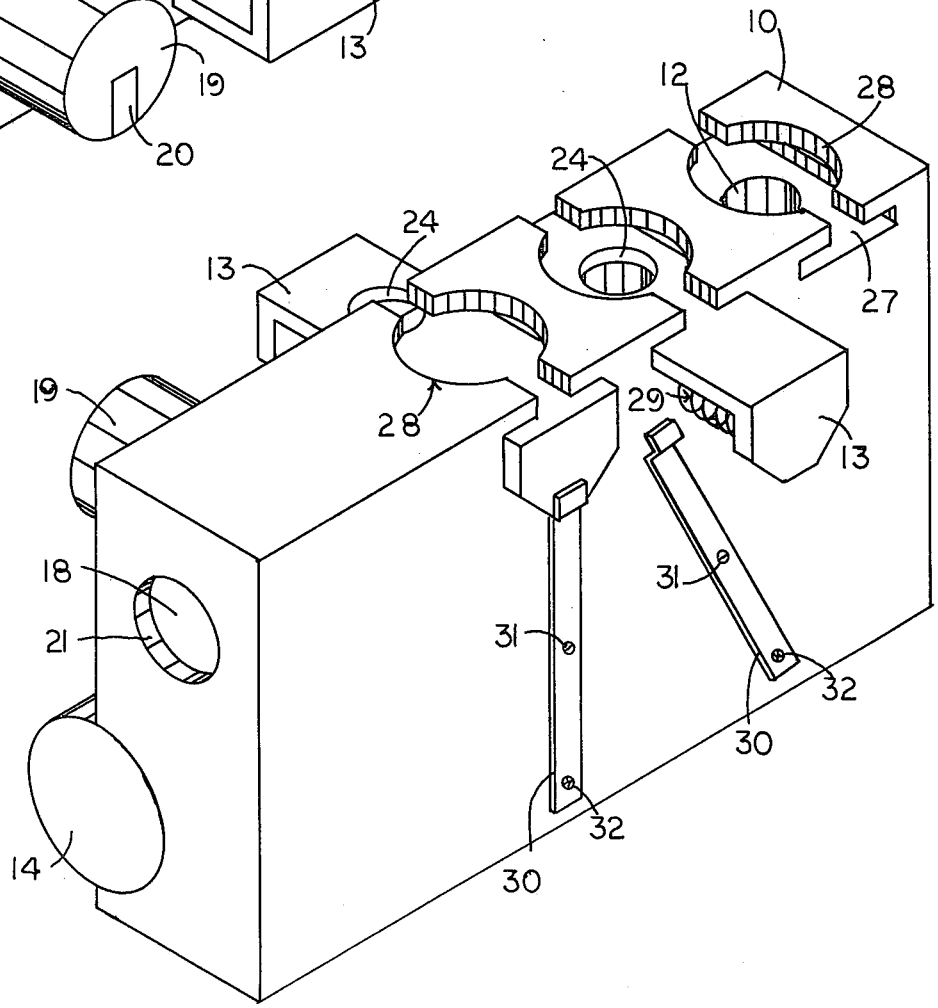
FIG. 2 is a bottom perspective view of this loading block showing the exclusive T-slot spring slide system. One of the slides has been removed to better show the milled T-slot.

Other features of the invention are shown in FIG. 1. The ball starter (14) is recessed into block (10) and held in place by clip (15) and a corresponding notch in ball starter (14). The clip is held in place by screw (16). A shooter wishing to carry block (10) around his neck may use carrying strap (22) which is attached by screw (23). Holes (25) are punched in strap (22) to receive percussion caps (26) to be used for percussion type firearms. For flintlock type firearms, a clear plastic squeeze bottle (18) is glued into hole (17). A cap (19) with a flip-type spout (20) is screwed onto bottle (18). A hole (21) is drilled into block (10) to allow the shooter to squeeze the bottle (18) with his finger.

What is claimed is:

1. A self-contained loading device for loading muzzle-loading firearms, comprising:

(a) an elongated block having a top face, a bottom face and a vertical dimension;

(b) a plurality of longitudinally spaced, cylindrical bores, extending vertically through said block, each of said bores having a diameter consistent with that of the caliber of a gun muzzle to be loaded;

(c) each of said bores having a height sufficient to allow the pre-loading of gunpowder, a patch, and a projectile;

(d) a plurality of cylindrical recesses bored into said bottom face with each cylindrical recess concentric with one of said longitudinally spaced bores and having a diameter consistent with that of the outside diameter of said gun muzzle to be loaded; and (e) a plurality of circular indentations on said top face, each circular indentation being concentrically located around one of said longitudinal bores and having a diameter consistent with the diameter of a patch for centering the patch over the longitudinal bore.

2. The loading device of claim 1 wherein:

(a) said block has a plurality of slots extending therethrough with each slot being transverse to one of said longitudinal bores;

(b) egress of the gunpowder, patch and projectile from the longitudinal bores is controlled by slides, each slide being mounted for lateral movement in one of the slots in said block, and having a bore hole with a diameter equal to that of the longitudinal bore, the slide blocking the egress of the gunpowder, patch and projectile in the longitudinal bore when its bore hole is laterally offset from the longitudinal bore and allowing egress of said gunpowder, patch and projectile when the bore hole is in alignment with the longitudinal bore;

(c) each slide having a perpendicular bend at each end thereof limiting its lateral movement;

(d) activation of each slide is accomplished by a spring and a lever, each spring being housed in holes bored in said block and in one of said perpendicular bends of the slide, each lever being pivotally attached to said block by a screw and positioned to hold the slide in a closed position until the lever is manually pivoted about said screw to allow the spring to push the slide into an open position with its bore hole in alignment with the longitudinal bore.

3. The loading device of claim 1 wherein:

(a) said block has a recess hole with a diameter equal to the diameter of a plastic priming powder bottle to be received therein;

(b) said priming bottle being adhesively secured in said recess hole for providing ready access to priming powder therein to be used in flintlock-type muzzleloading firearms; and (c) said block has a hole located adjacent to and intersecting said recess hole to facilitate squeezing said plastic priming powder bottle to project priming powder into a primer flash pan of a flintlock-type muzzleloading firearm.

4. The loading device of claim 1 wherein:

(a) said block has a semi-circular recess and a lateral groove in one side thereof to hold and contain a similarly sized ball starter;

(b) said semi-circular recess having a diameter similar to that of a larger end of said ball starter and said lateal groove having a width similar to the diameter of a smaller end of said ball starter; and (c) said ball starter is held in said semi-circular recess and said lateral groove by a clip on said block extending over said lateral groove.

* * * * *